US007559821B2

(12) United States Patent
Pacheco

(10) Patent No.: US 7,559,821 B2
(45) Date of Patent: Jul. 14, 2009

(54) BUILDING BLOCK

(76) Inventor: Francisco Pacheco, P.O. Box 1100, Heredia (CR) 3000

( * ) Notice: Subject to any disclaimer, the term of this patent is extended or adjusted under 35 U.S.C. 154(b) by 0 days.

(21) Appl. No.: 11/455,834

(22) Filed: Jun. 20, 2006

(65) Prior Publication Data

US 2006/0234600 A1 Oct. 19, 2006

Related U.S. Application Data

(63) Continuation-in-part of application No. 10/432,776, filed as application No. PCT/CR00/00005 on Nov. 24, 2000, now abandoned.

(51) Int. Cl.
*A63H 33/08* (2006.01)
*A63H 33/00* (2006.01)

(52) U.S. Cl. ..... 446/108; 446/92; 446/115; 273/157 R

(58) Field of Classification Search ..... 446/85, 446/92, 108, 109, 115, 120–122; 273/155, 273/157 R See application file for complete search history.

(56) References Cited

U.S. PATENT DOCUMENTS

| | | | | | |
|---|---|---|---|---|---|
| 1,282,188 | A * | 10/1918 | Catlett | ..... | 106/683 |
| 3,605,324 | A * | 9/1971 | Adams | ..... | 446/431 |
| 5,100,359 | A * | 3/1992 | Gorio | ..... | 446/124 |
| 5,823,843 | A * | 10/1998 | Pohlman | ..... | 446/120 |
| 6,116,979 | A * | 9/2000 | Weber | ..... | 446/92 |
| 6,379,212 | B1 * | 4/2002 | Miller | ..... | 446/85 |

* cited by examiner

*Primary Examiner*—Kien T Nguyen
(74) *Attorney, Agent, or Firm*—H. Jay Spiegel; Robert L. Haines

(57) ABSTRACT

The present invention provides such a spherical block structure wherein each spherical block is made up of three intersecting rings corresponding to the three axes (x, y and z) of the sphere. Each ring comprises eight subunits with two of those subunits being shared with each of the other two rings. The spherical block structure created by the intersecting rings results in a hollow center with eight cavities radiating outward, the cavities providing a location for the disposition of a connection means whereby individual spherical blocks may be releasably connected to form larger structures.

15 Claims, 5 Drawing Sheets

BUILDING BLOCK

CROSS REFERENCE TO RELATED APPLICATION

This application is a continuation-in-part application of Ser. No. 10/432,776 filed May 27, 2003, which claims the benefit under 35 U.S.C. 365(c) of PCT application PCT/CR00/00005, filed Nov. 24, 2000.

TECHNICAL FIELD

This invention refers to the field of construction of structures through block gearing. The tiling system has other applications in the fields of geology, chemical structures, communication networks and graphic design.

The present invention is particularly directed towards the production of toy building games or systems in the structure of a "Toy Building Block" with which one may build regular or curved structures.

The current building block toys are based on a cube. However, the cube can only be projected in straight lines and in 90-degree angles. This characteristic constitutes a strong point in the case of square edifications, but lacks functionality when attempting to construct curved figures, for example all the designs of nature.

The current systems are inflexible and further more give the child an incomplete concept of space, since its true nature is curved. It is a reality that in the world there is an enormous variety of forms like plants, animals, the waves of the ocean and the mountains. It is also certain that some type of design sustains all this structures. Although we are not clear about the system nature has, we know that it is not based on the cube, but on the sphere, represented in the atoms and molecules.

In order to join spheres the union axis must make contact in different directions at the same time, which complicates the gearing or connection system. A practical solution in a building block toy is to use magnetism as the attachment force between the individual blocks or pieces. What is needed is a symmetrical spherical block structure which permits the distribution of the magnetic energy within the sphere such that the individual spheres can connect together in any order and relationship.

The present invention provides such a spherical block structure wherein each spherical block is made up of three intersecting rings corresponding to the three axes (x, y and z) of the sphere. Each ring comprises eight subunits with two of those subunits being shared with each of the other two rings. The spherical block structure created by the intersecting rings results in a hollow center with eight cavities radiating outward, the cavities providing a location for the disposition of a connection means whereby individual spherical blocks may be releasably connected to form larger structures.

SUMMARY OF INVENTION

It is an object of the present invention to provide a building block structure which is based on a sphere.

It is a further object of the present invention to provide a spherical building block structure whereby individual building blocks are releasably connectable to form complex structures.

It is a still further object to provide a spherical building block structure whereby individual building blocks are releasably connectable by magnetic means to form complex structures.

Further objects and advantages will become evident by reference to the following description and drawings.

Thus, the present invention provides a building block toy having a body of substantially spherical shape which comprises three intersecting rings, each ring made up of a plurality of square panels, each panel having diagonals measuring ⅛ of the circumference of the spherical body. The panels are joined in cooperating spaced pairs to form a subunit wherein a first panel forms a semispherical upper surface and the second panel forms a substantially flat lower surface with angular faces therebetween. A plurality of the subunits are joined at adjacent angular faces to form the spherical body wherein the semispherical upper surfaces are outermost.

The present invention further provides a spherical building block toy comprising a substantially spherical body comprising three intersecting rings, those rings being arranged in an intersecting cooperation centered on three axes, x, y and z, to form the spherical body, and defining a plurality of cavities therebetween extending inward of the spherical body and each cavity having a releasable connection means therein.

The present invention still further provides a toy building set comprising a plurality of building blocks of a substantially spherical shape, each comprising three intersecting rings located along the x, y and z axes of the building block, each ring comprising a plurality of subunits with each subunit comprising a body having a semispherical upper surface and a substantially flat lower surface each having four sides of substantially equal length forming a square perimeter, the upper surface having a triangular face extending downward at an angle from each side and the lower surface having a triangular face extending upward at an angle from each side, the triangular faces of one surface interdigitating with said triangular faces of said other surface to form a subunit having an upper surface, a lower surface spaced therefrom and a periphery of interdigitated triangular faces, whereby the planes of opposite triangular faces of each subunit describe an angle of 45°, whereby joining the subunits at opposite lower surface triangular faces forms the rings and the rings define a plurality of cavities extending inward from the surface of the body to a center point within the body, and having releasable connection means disposed within the cavities and cooperable with such connection means of adjacent building blocks.

DETAILED DESCRIPTION

The spherical building block of the present invention is derived from a cube and is, itself, the product of a plurality of squares folded and assembled to form the individual subunits that are joined together to form the intersecting rings.

Figure 2:
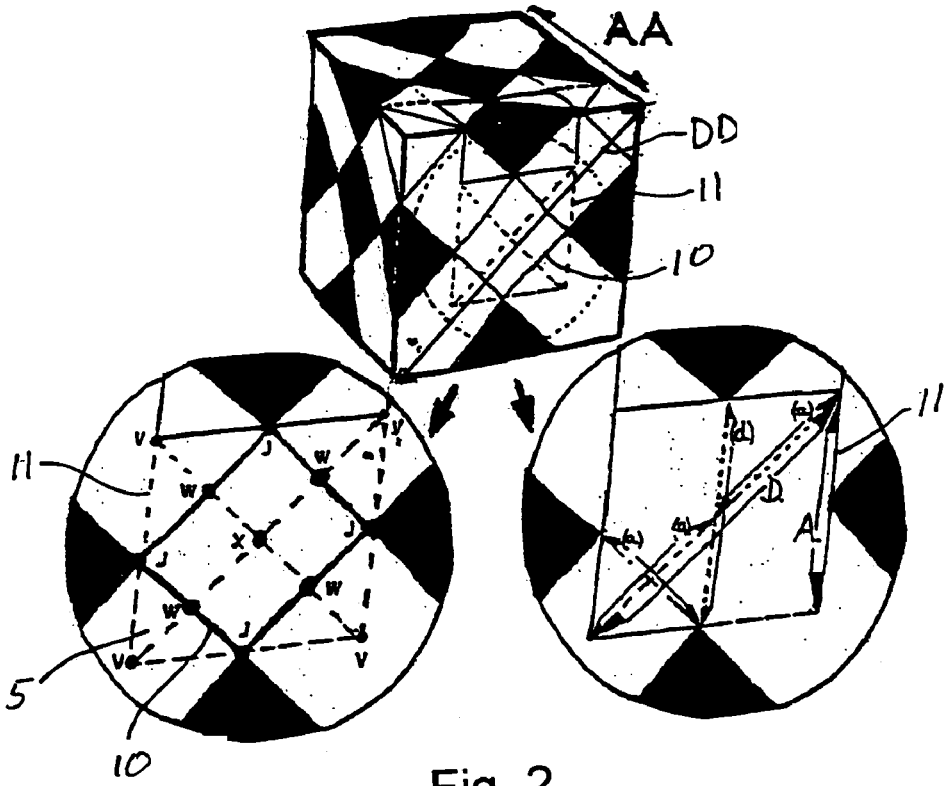
FIG. 2, illustrates the relationship between a cube and a sphere and the derivation of the squares making up the subunits of the building block of the present invention.
Figure 3A:
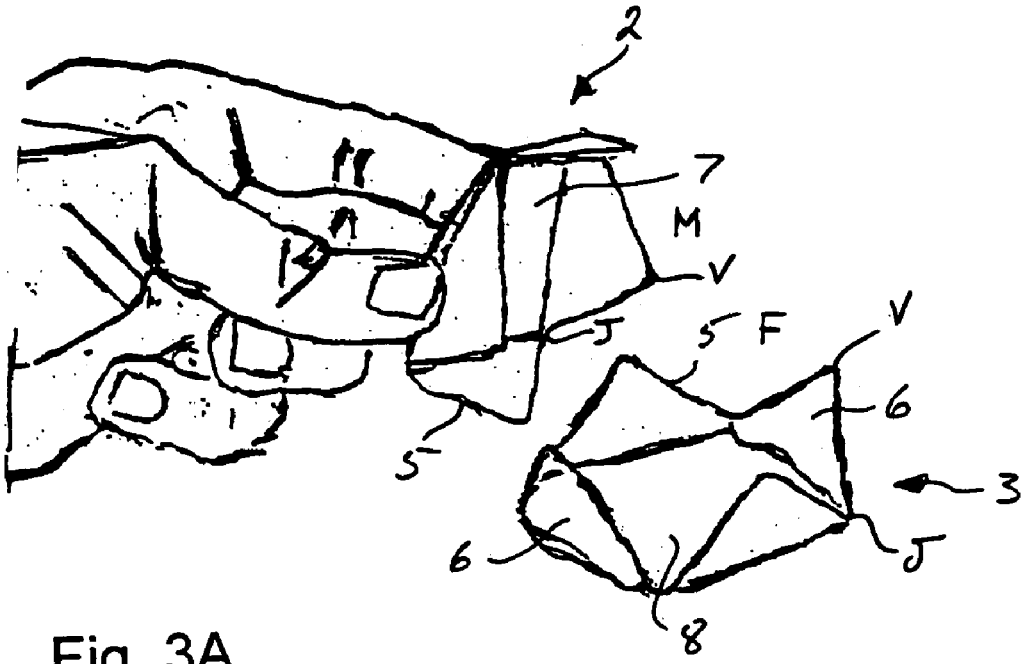
FIG. 3A, illustrates the assembly of a subunit of the building block of the present invention from two halves M and F.
Figure 3B:
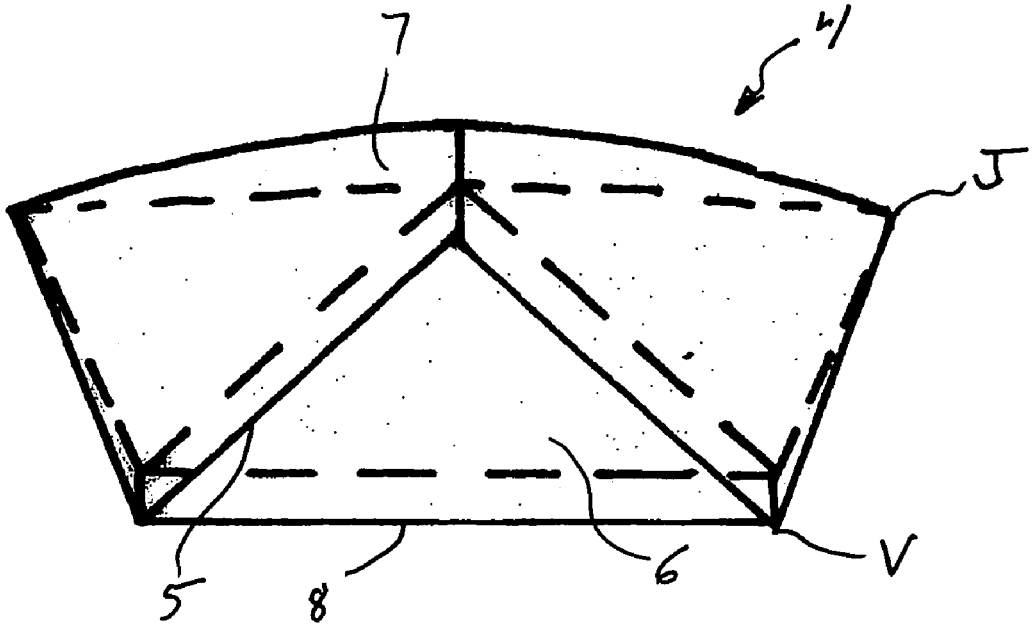
FIG. 3B, illustrates the complete subunit of the building block of the present invention.

To form a spherical building block 1 having a circumference C according to the present invention, cut 36 squares measuring along side A=⅛ of the circumference C (FIG. 2). Group the squares in 18 pairs in the following way: rotate each square in a pair to be 45° relative to each other to form an eight point star, bend the corners of the upper square 2 downward and the corner of the lower square 3 upward as shown in FIG. 3A and join each pair only by their adjacent borders. After the union you have a subunit 4, as shown in FIG. 3B, with two flat lids (each one measuring $A/\sqrt{2}$) and four fitting angles on the sides forming a periphery of eight interdigitated triangles 5 or angular faces, whereby the opposing triangles 5 of the lower square 3 form each of the fitting angles 6 (FIG. 3B).

To permit eight of the subunits 4 to combine to form a ring 9, the fitting angles 6 have to be adjusted to an external angle of 45 degrees, which obliges the exterior lid or upper surface 7 to adopt a semispherical curvature while the interior lid or lower surface 8 remains flat. Eight of the subunits 4 are then joined at adjacent angular faces or fitting angles δ to form a complete ring 9 with eight subunits 4 (45°×8=360°). The ring 9 is repeated around each axis of the sphere 1 (xyz) to form three intersecting rings 9 with eighteen pieces or subunits 4 (FIGS. 1A, B and C) thereby producing one complete spherical building block with each ring being orthogonal to the other two and having its geometrical center at the center of the resulting spherical building block and corresponding to the center of the XYZ coordinate system.

Figure 1A:
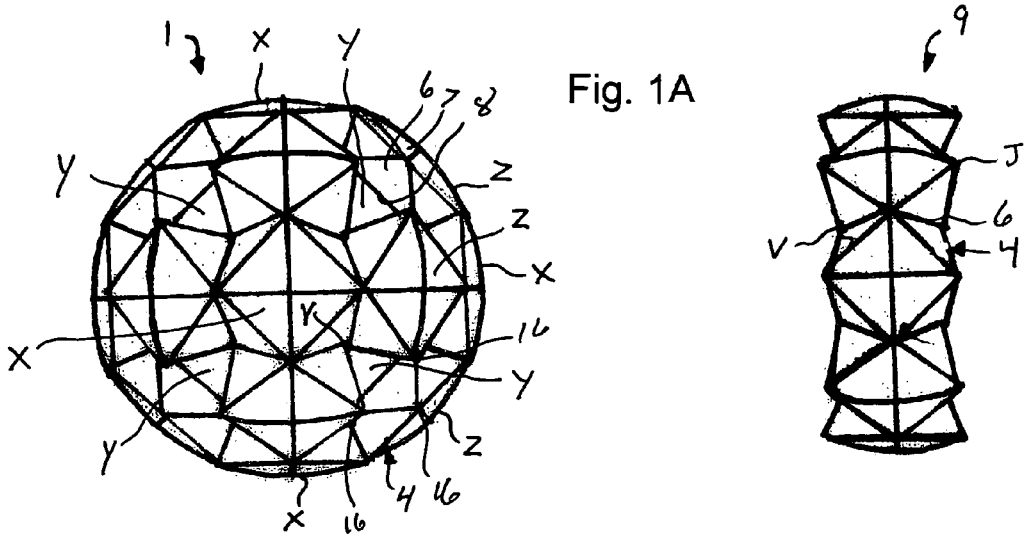
FIGS. 1A-C, show three points of view, X, Y and Z, of the spherical building block of the present invention and the individual rings of each axis x, y and z.

This procedure is so simple since the nature of the square contains in its proportion the capacity to form spheres, or substantially spherical bodies 1. It is the exact relation between the side and the diagonal, what allows the thirtysix squares to form a union system that is perfectly symmetrical and exact. FIGS. 1A, B and C, show three points of view for the Building Block, X, Y and Z, and the corresponding rings x, y and z made up of the subunits 4.

This patent application is related to applicant's copending application Ser. No. 10/398,405 titled COVER FOR BALL OR SPHERE, originally filed as PCT/CR00/00003, filing date Oct. 10, 2000. which describes a surface scheme based on the similar principal of eighteen squares to form a sphere.

Figure 1B:
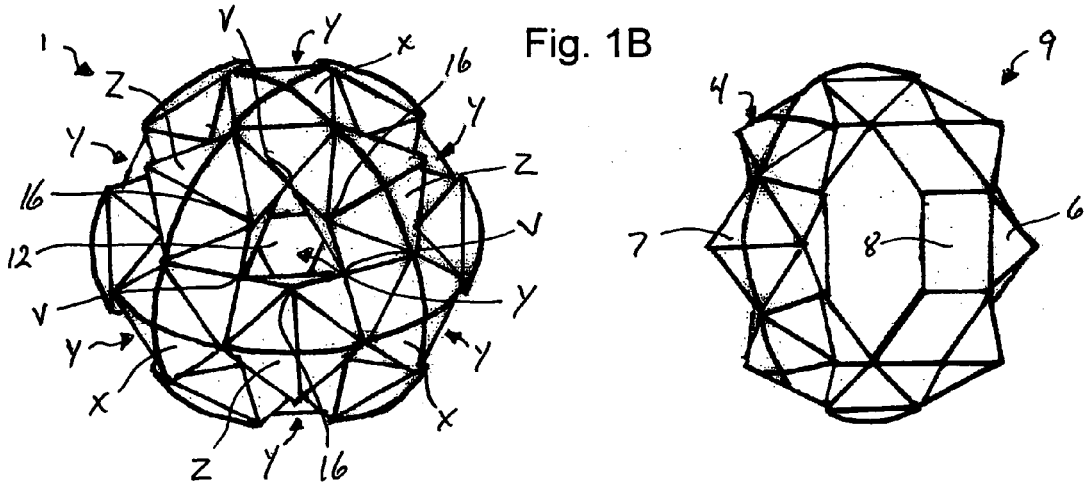
Figure 1C:
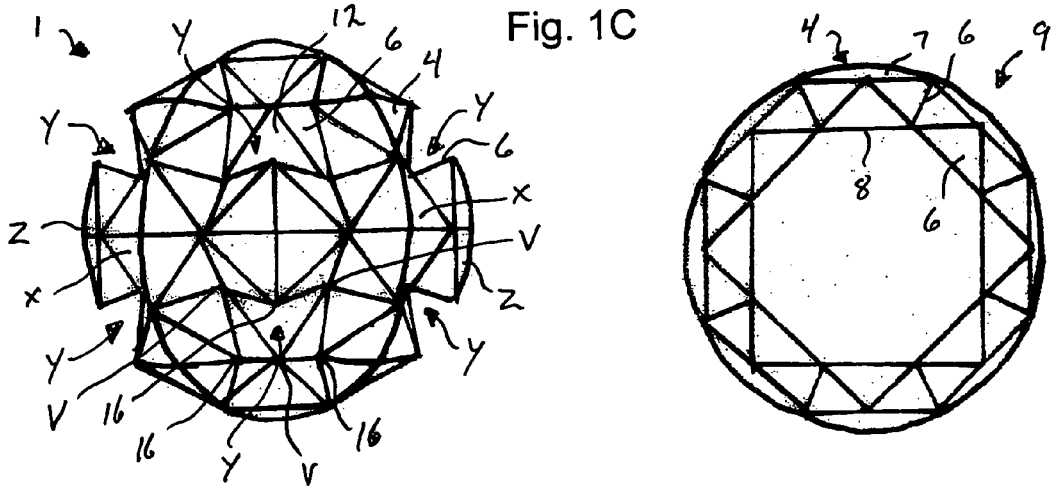

This Surface Scheme states the symmetrical accommodation of eighteen square pieces with diagonals measuring d=⅛C (note that ⅛C=A, but we will later see how d=A). The squares 2 that correspond to the described semispherical upper surfaces 7 of the subunits 4 are joined along their diagonals forming a circle or ring 9 of eight subunits 4 around the axes (x, y, z) as shown in FIG. 1. Even though three circles or rings 9 of eight subunits 4 add up to twenty four pieces or subunits 4, the sphere 1 can be built with eighteen subunits, since the rings 9 share subunits 4 in six intersections. These six intersection subunits are called X (FIG. 1A) because the letter represents the crossing of the two directions. The other twelve subunits are called Z (FIG. 1C) because this letter represents the ecliptic.

When accommodating the subunits in three circles you are assuring that each ring 9 will have an identical circumference C1 and you can perfectly define the eight octants. The calculation difficulties present themselves in the determination of the central point Y of the octant. If the six centers X or intersection subunits represent a cube's faces, the eight centers Y corresponding to cavities 12 are equivalent to the corners of the cube. Furthermore, the "not" intersected subunits Z are located in the borders of the cube in an intermediate zone between X and Y.

The following summarizes the terms and formulas used in calculating the squares used to make up the subunits for rings and a sphere of a particular circumference C:

| | | |
|---|---|---|
| Diagonal of the "small square" | (d) = | ⅛C |
| Side of the "small square" | (a) = | $d/\sqrt{2}$ |
| Side of the equilateral triangle | (c) = | $\sqrt{3} \times (d - a)$ |
| Height of the triangle | (h) = | $\frac{1}{2}c \times \sqrt{3} = \frac{3}{2}(d - a)$ |
| Height of the trapeze | (b) = | $\sqrt{(a''-e'')}$; $e = \frac{1}{2}(a - c)$ |
| Length of the ecliptic strip | (2k) = | 6b + 3a + 3c; width: b + e |

Measurements of the circumferences for the sphere:

C1=8d

C2=2a+4b+4h+2d $C3=2\times\sqrt{(k''+(b+e)'')}$

When $c=\sqrt{(3)}\times(d-a)$, then h=3/2(d−a) and also C1=C2+4(a−b)≈C3

When c=6.322 . . . % C, then C3=C1 and if the ecliptic is fixed altering only c2=5.5213 . . . %, then C1=C2=C3.

It is important to clarify some concepts and ideas of applicant's copending application to help determine the characteristics of the inward extending cavities of the spherical building block of the present invention. In that document we mention that 18 black squares represent the true surface of the cube and the rest of the white pieces constitute empty space. A more certain explanation in the case of the building block of the present invention is that the white pieces are folded towards the interior of the sphere 1 forming eight cavities 12 extending inward to the center of the solid. This folding operation is of great importance for this document, since it explains the structure of the Building Block.

Furthermore, we have to correct the meaning of the terms "small square" and "big square". The small square 10 will continue being the one with the measurements $a=d/\sqrt{2}$ and the diagonal d=⅛C. Notwithstanding, the big square 11 has new measurements A=d and D=2a. To avoid confusions with the descriptions of the copending application, the measures of the face of the cube herein will be AA=2d and the diagonal DD=4a.

This is seen in FIG. 2, where the corners of the big squares 11 are called V and between these corners we find J. The four points J form the "small square" 10, corresponding to the upper and lower surfaces 7 & 8 of the subunits 4, inscribed inside the big square 11. One upper or lower surface plus four angular faces along the sides form a big square 11. With the diagonals of the small square 10 you measure the sides of the big square 11 and with the sides you measure the diagonals. We will call W the central point of the path (a) of the small square.

| | Small square: | Big square: |
|---|---|---|
| Side: | JWJ = VWX = WXW = a = ½D | VJV = JXJ = A = d |
| Diagonal: | JXJ = d = A | VWXWV = D = 2a |

The vertices V appear at the white whole square diagonal crossing in the cube, while in the sphere 1 the vertices V correspond to the apexes of the triangles 5 and define either a point towards the interior of the sphere 1 or the corner points of the upper surface 7 of the subunits 4. These vertices V together with the angular faces 6 define the cavities 12 at Y on the spherical block 1.

Figure 4:
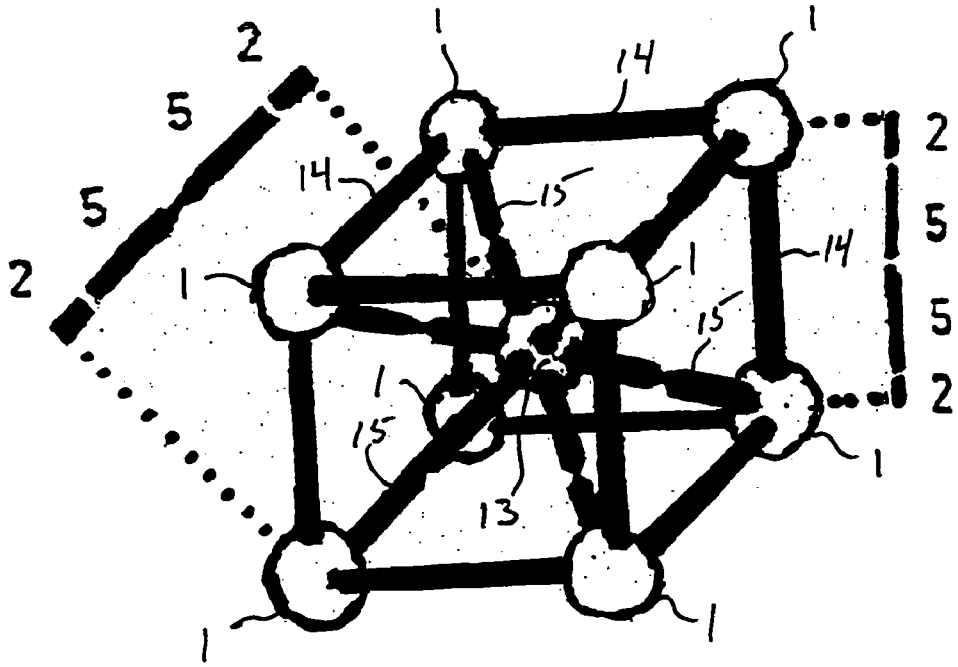
FIG. 4, illustrates the positioning of a ninth sphere within a cube formed by 8 spheres and is a representational image of the placement of magnetic connection means relative to the cavities of the spherical building block of the present invention corresponding to the corners of a cube.

A cube can also serve as an imaginary frame to guide the position of nine spherical blocks 1 to form a cubical structure. Take a cube with a side AA=18. Each of the eight corners is the nucleus of a spherical block 1 with radius R=8.91≈9. It is impossible to place a ninth sphere 13 with a similar radius in the nucleus of the cube, unless you allow an overlap among the spheres. The calculation for that overlap is as follows: the space diagonal of the cube measures $\sqrt{(DD''+AA'')}\approx 31.2$; the corner radiuses and the double radius of the ninth sphere add up to ≈35.6 and the overlap is ≈4.44. If we are able to build a sphere with a gearing or connection of ½overlap≈2.22 we can introduce the ninth sphere 13 and so connect the space not only through the axes 14 (x, y, z) but also through the 4 diagonal axes 15 or space diagonals as shown in FIG. 4.

Since the ninth sphere 13 is in the center, the connection is given with the eight spheres around it. In order to maintain the symmetry, the gearing or connection must be located in the centers Y of the eight octants corresponding to the cavities 12. We point out that in reality all the spheres can be a ninth sphere, depending on where the borders that outline it are located.

As should now be clear, the starting point for the spherical building block 1 of the present invention is the square. The union of two squares forms a Pair or subunit 4 and the union of eighteen Pairs or subunits 4 in three intersecting rings 9 forms spherical Building Block 1 that allows for the joining of multiple blocks 1 in the seven directions, three for the x, y, z axes 14 and in four space diagonal directions 15.

The basic component of the block 1 is the Pair or subunit 4, made up by the union of two big squares 11, with M as the exterior surface 7 and F as the interior surface 8. M and F are joined in a complementary way as shown in FIG. 3A. Starting at any point: J of M and V of F, they are joined at the sides until the next intersection V of M with J of F and continuing that way around the periphery until arriving to the starting point. At the end you obtain eight J-V unions.

At the moment of the folding, the big square 11 of one of the pairs forms a plane or flat surface with the size of the small square 10 and the leftovers at the corners are folded in the direction of its pair's corners to form the angular faces 6. These leftovers or angular faces 6 are the triangles JVJ 5 and are interdigitated between the pairs F and M of the subunit 4 to close the existing space between the two planes, the one of F in the interior or flat lower surface 8 and the one of M in the exterior or spherical upper surface 7 as shown in FIGS. 3A and B.

We now describe an imaginary frame or Support that serves as guide to locate each of the pairs or subunits 4. Starting with a cube with sides 12 and diagonal 17, the numbers are rounded to avoid dealing with square roots, graphing of the cube's faces is described as five squares and four rectangles: one central square (5), four corner squares (3.5) and in the borders of the central square, four rectangles (5×3.5). Cut the twelve borders of the cube at the diagonal of the squares (3.5) and the new face measures 5 like the central square. The perimeter C1 is no longer 4×12=48 but 8×5=40. Finally a cut in the corners of the cube forms eight equilateral triangles with side 5. The resulting figure is a rhombicuboctahedron composed of eighteen squares and eight equilateral triangles, all with sides $a=d\sqrt{2}$, and represents the eighteen bases on which to sit the Pairs or subunits 4 on the side F or lower flat surface 8 and is nothing more than a visual guide since the pairs are sustained among themselves.

If we cut over any circumference C1, the Support appears like a regular octagon with sides 5. On the outside we outline an octagon with sides d=7 whose circumference equals C1. The octagon has two radiuses, the subscribed and the circumscribed. The radius that the outer octagon d=7 must adopt to reach the lower flat surface of F is the radius for a circle C1=8d=56.

In a plane view, the diagonal path of the big square that appears over the Support is WXW=5 or "a" and it must not be mistaken with JWJ with a similar measurement 5 or "a". The total diagonal path of the lateral view F cut is D=2a, that is equal to the sum of 2.5+5+2.5 or ½a+a+½a=2a. The leftovers of F, called WV=½a=2.5, and which form the angular faces 6 go up through the line of the radius seeking the encounter with M between the corresponding angular faces 6 thereof, but they cannot go farther since their job is to maintain the 45 degree angle that allows for the formation of the subunit 4. It is M which must make an effort to reach F to close the openings. When M finds F the periphery is closed, the surface 7 of M becomes semispherical and the subunit 4 is formed as shown in FIG. 3.

At the end, the important thing is that with eighteen Pairs or subunits 4 you can form the spherical building block 1 and in it eight gearings or connections with the exact need measurement for the overlap that allows for the introduction of the ninth sphere 13 and the view of the seven paths.

We now present a practical system to describe the magnetic flow and to locate the magnets easily in the different octants. We make reference to the cube in order to facilitate the location, but we are talking about a spherical building block of the present invention. We number each face in accordance with the numbers of a game dice: 1 on the front, 2 top left, 3 top right, 4 bottom left, 5 bottom right and 6 on the back. The opposing faces are therefore 3&4, 2&5 and 1&6. The twelve borders or edges of the die are 2-3, 2-5, 4-5, 2-4, 1-2, 2-6, 5-6, 1-5, 1-3, 3-6, 4-6, and 1-4. The octants corresponding to the corners Y are determined by the union of three faces and are represented with respect to the spherical building block 1 in FIG. 6.

Each four corner group is separated among its members by DD and from the members of the other group by AA. This is reasonable since the distance between similar charges must be greater than the distance between contrary charges. In the sphere this difference is balanced, as long as we take into account the width of the energy, even though there is always a fixed difference to promote the flow without having a disorder.

Figure 6:
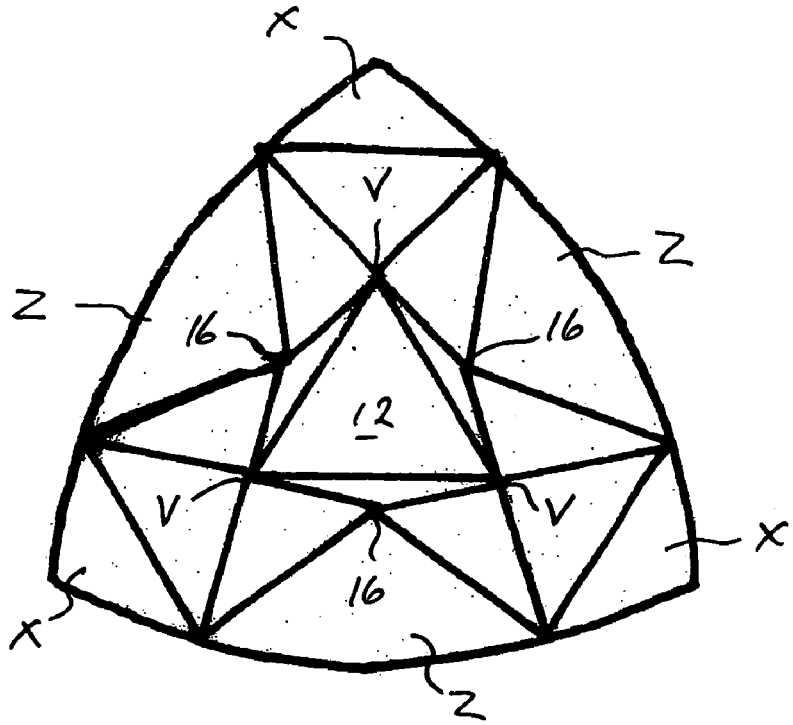
FIG. 6, illustrates one octant of the spherical building block of the present invention.

The gearing or connection among spheres takes place at points Y which correspond to the eight triangular cavities 12 formed between the three intersecting rings of subunits and are the spherical equivalent of the corners of the cube. FIG. 6 shows one such octant or corner with the triangular cavity 12 defined by the edges of three adjacent subunits 4, one from each ring 9 and corresponding to the Z subunits of those rings. Midway along each side of the triangular cavity 12 are free corner points 16 of the upper surface 7 of the Z subunits which correspond to the corners J of the small square 10 forming the upper surface 7 of the subunit 4. When two spherical building blocks 1 are brought together to create a larger structure, the free corner points 16 fit into corresponding apexes of the triangular cavity 12, which correspond to the corners V of the big square 11, to provide a gearing or intermeshing between adjacent spherical building blocks which serves to hold the adjacent blocks in registry with each other.

Although the gearing or intermeshing between adjacent spherical building blocks 1 holds the blocks in registry with each other, it is not sufficient to hold the individual blocks 1 together so as to permit a structure to be constructed without that structure simply falling apart due to gravity. Whereas many means could be employed to secure a plurality of the spherical building blocks 1 together to form a structure, including mechanical connectors, adhesive, electrostatic attraction, or the like, a simple and readily engagable and releasable connection means is preferred. For this purpose it has been found that magnetic attraction is preferred. Indeed, the construction of the spherical building block 1 from three intersecting rings 9 facilitates the use of magnets as a releasable connecting means between adjacent spherical building blocks.

For the case of the Toy Building Block, in an initial stage the creation of the magnetic flow is not necessary but only the right location of the polarities of the magnets in the centers Y of the cavities 12. Thus, the gearing or connection of multiple spherical building blocks of the present invention by the intermeshing of the free corner points 16 takes place at the centers Y corresponding to the cavities 12 in which the poles of magnets corresponding to the space diagonals 15 are located. The combination of magnetic attraction and the gearing or intermeshing of adjacent spherical blocks provides a more positive engagement than would be possible with purely spherical building blocks not having the subunit ring structure of the present invention. Furthermore, since the intersecting ring structure of the spherical building block results in eight cavities 12, as opposite pairs, each pair can represent a north and a south magnetic pole. Preferably, the magnetic poles are fixed at their respective locations. However it is conceivable within the present invention to include versions with the magnets held within the cavities by flexible means, such as springs, to allow a degree of flexibility and movement of the union between adjacent spherical building blocks 1 thereby providing some resilience to a structure constructed from the blocks.

Figure 7:
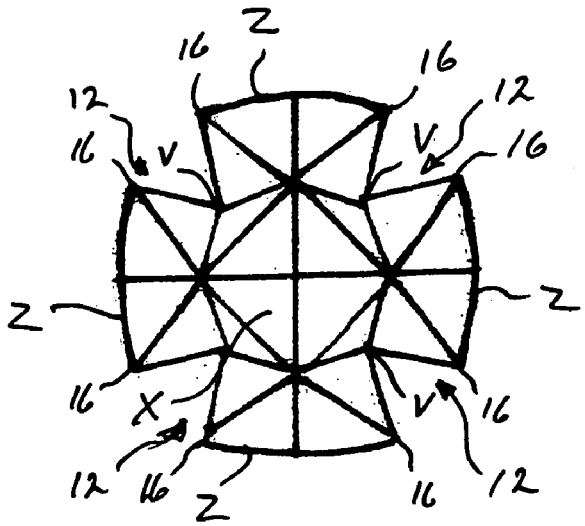
FIG. 7, illustrates an alternative one-sixth subunit of the spherical building block of the present invention.

The above description explains the derivation of the spherical building block of the present invention from a cube and a plurality of squares defining the faces of the cube, the subunits of the building block corresponding to those squares. However, it will be readily appreciated that the subunits 4 may be individually molded according to the dimensions and angular relationships set forth and assembled to form the spherical building block 1 made up of three intersecting rings x, y and z. Furthermore, the size of the building block can be scaled to any requirement since the proportions of the subunits 4 are constant. In a still further alternative manufacturing method shown in FIG. 6, the spherical building block 1 may be assembled from six molded faces 16 each comprising a whole subunit 4 at the center with a half subunit 17 on each side forming a module having the shape similar to that of a Maltese cross, FIG. 7. The molded faces 16 are united at each arm of the cross structure to form the spherical building block 1 with magnets located at each cavity 12 defined by the corners of three adjoining molded faces 16.

Figure 5:
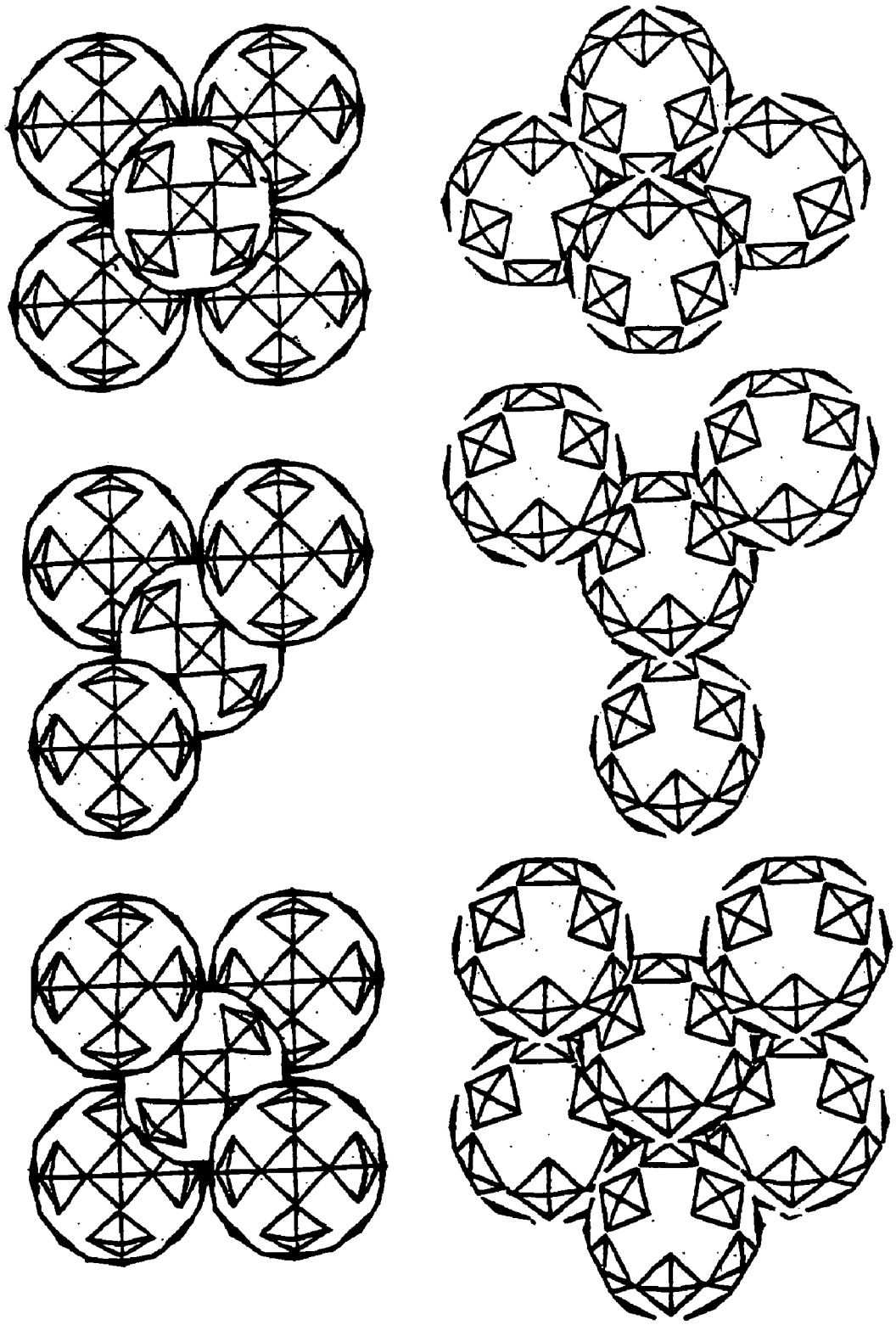
FIG. 5, illustrates representational structures assembled from a plurality of the spherical building blocks of the present invention.

Using the building block 1 of the present invention it is possible to assemble different and complex structures as represented by FIG. 5 providing a flexibility in the creation of figures not possible with conventional building blocks.

While the invention has been described with respect to certain specific embodiments, it will be appreciated that many modifications and changes may be made by those skilled in the art without departing from the spirit of the invention. It is intended, therefore, that all such modifications and changes are within the true spirit and scope of the invention as recited in the following claims.

What is claimed is:

1. A building block toy comprising a body of spherical shape, said body comprising a plurality of subunits each comprising a pair of square panels, each panel measuring ⅛ of the circumference of said spherical body and joined in cooperating spaced pairs to form each said subunit having a curved upper surface and a flat lower surface with angular faces therebetween, and whereby a plurality of said subunits are joined at adjacent angular faces to form said spherical body wherein said curved upper surfaces are outermost.

2. The building block toy of claim 1, wherein said joined subunits form three rings arranged in intersecting cooperation about three axes, x, y and z, to form said spherical body.

3. The building block toy of claim 2 wherein each ring comprises eight subunits whereby two of said subunits of each ring are shared with each of the other of said rings.

4. The building block toy of claim 3, wherein each subunit comprises an upper surface, a spaced lower surface and a periphery of eight interdigitated triangles comprising said angular faces, whereby each of said triangles comprises a base corresponding to one side of said square panels and each of said triangles describes an angle to the plane of its respective panel, whereby said angular faces of opposite triangles describe an angle of 45°.

5. The building block toy of claim 4 further comprising said subunits being joined along diagonals of said upper surface at adjacent opposite angular faces of said second panel whereby said curved upper surfaces are outermost and form the outer surface of said rings and said flat lower surfaces are innermost and form the inner surface of said rings.

6. The building block toy of claim 5 further comprising eight cavities defined between said rings and extending inward to the center of said spherical body, each cavity having a central axis.

7. The building block toy of claim 6 further comprising a connection means disposed within said cavities, said connection means being cooperable between said spherical bodies whereby a plurality of said spherical bodies are releasably connectable.

8. The building block toy of claim 7 wherein said connection means comprise magnets.

9. A spherical building block toy comprising a spherical body comprising three intersecting rings about three axes x, y and z, said rings defining a plurality of cavities therebetween, said cavities extending inward of said spherical body and having releasable connection means therein whereby a plurality of said spherical bodies are releasably connectable, said spherical building block toy further comprising a plurality of subunits joined to form said rings, said subunits each comprising a body having a curved upper surface and a flat lower surface each having a square shape with four sides of equal length, said upper surface further comprising a triangular face depending downward at an angle from each of said four sides and said lower surface further comprising a triangular face extending upward at an angle from each of said four sides, said triangular faces each having an area ¼ that of said upper or lower surface and said triangular faces of said upper surface interdigitating with said triangular faces of said lower surface thereby defining a subunit having an upper surface, a lower surface spaced therefrom and a periphery of interdigitated triangular faces therebetween, whereby the planes of opposite triangular faces of each subunit describe an external angle of 45° relative to the respective surface.

10. The spherical building block toy of claim 9 wherein said rings each comprise eight of said subunits joined along diagonals of said upper surfaces at adjacent lower surface triangular faces.

11. The spherical building block toy of claim 10 wherein said cavities are substantially triangular in shape defined by one side for a subunit from each of said rings, each of said cavities comprising a corner point of said subunit midway along each side and a depression at each apex, whereby said corner points of one spherical building block toy fit into said depressions of an adjacent spherical building block toy providing an intermeshing or gearing engagement of said corner points.

12. The spherical building block toy of claim 11 wherein said connection means comprises magnets.

13. The spherical building block toy of claim 12 further comprising eight cavities defined by said intersecting rings, said cavities comprising four polar opposite pairs, each pair having a north and a south magnetic pole.

14. A toy building set comprising a plurality of building blocks of spherical shape, each building block comprising three intersecting rings located along X, Y and Z axes of said spherical shape building block, each ring comprising a plurality of subunits, each subunit having a curved upper surface with a square perimeter, a plurality of said subunits being joined along diagonals of said upper surfaces to form said rings, said rings defining a plurality of cavities therebetween, and releasable connection means disposed within said cavities cooperable with connection means of adjacent building blocks whereby said plurality of building blocks are releasably connectable.

15. The toy building set of claim 14 wherein said connection means comprises magnetic means located within said cavities.

* * * * *